US009656731B2

(12) United States Patent
Doig

(10) Patent No.: US 9,656,731 B2
(45) Date of Patent: May 23, 2017

(54) PERSONAL WATER CRAFT DRIVE-ON DOCK

(71) Applicant: Daniel Doig, Innisfil (CA)

(72) Inventor: Daniel Doig, Innisfil (CA)

( * ) Notice: Subject to any disclaimer, the term of this patent is extended or adjusted under 35 U.S.C. 154(b) by 0 days.

(21) Appl. No.: 15/081,908

(22) Filed: Mar. 27, 2016

(65) Prior Publication Data

US 2016/0280341 A1 Sep. 29, 2016

Related U.S. Application Data

(60) Provisional application No. 62/139,140, filed on Mar. 27, 2015.

(51) Int. Cl.
*B63B 35/44* (2006.01)
*B63C 1/10* (2006.01)
*B63C 1/02* (2006.01)

(52) U.S. Cl.
CPC . *B63C 1/10* (2013.01); *B63C 1/02* (2013.01)

(58) Field of Classification Search
CPC ..... B63C 1/02; B63C 1/10; B63B 35/44
See application file for complete search history.

(56) References Cited

U.S. PATENT DOCUMENTS 3,327,670 A * 6/1967 Burnett ..... B63B 9/00 114/47
3,478,710 A * 11/1969 Bethurem ..... B63C 1/02 114/266
2007/0169678 A1* 7/2007 Dickman ..... B63C 1/02 114/263

* cited by examiner

*Primary Examiner* — Stephen Avila
(74) *Attorney, Agent, or Firm* — Stuart L. Wilkinson

(57) ABSTRACT

A personal water craft (PWC) dock has a molded platform, the platform having a main section with its upper surface contoured to provide an elongate recess extending the length of the platform. The recess is shaped and dimensioned to receive and support the hull of a PWC, the recess being asymmetrically located towards one side of the platform. A raised walkway deck section extends the length of the platform and is located towards the other side of the platform, the walkway deck section being located over a buoyancy chamber. The molded platform is configured at each end of the recess for selective installation of a centering roller or a bow stop as desired for convenience when siting the PWC dock and its walkway deck section in relation to a main dock.

14 Claims, 5 Drawing Sheets

PERSONAL WATER CRAFT DRIVE-ON DOCK

CROSS REFERENCE TO RELATED PATENTS

The present U.S. Utility patent application claims priority pursuant to 35 U.S.C. 119(e) to U.S. Provisional Patent Application Ser. No. 62/139,140, entitled "PERSONAL WATER CRAFT DRIVE-ON DOCK" filed Mar. 27, 2015.

FIELD OF THE INVENTION

This invention relates to a floating dock and has particular but not exclusive application to a drive-on dock for a personal water craft (PWC).

DESCRIPTION OF RELATED ART

Personal water craft (PWC) docks or ports are used to support PWCs so that the PWC is located out of the water and is held in a relatively stable position pending further use. The PWC floats and is typically fixed to a larger fixed or floating dock or jetty. PWC docks are known which are configured so that the PWC can be driven onto the dock and parked. It would be useful to have PWC docks that are somewhat more versatile than those currently known.

DETAILED DESCRIPTION OF THE INVENTION INCLUDING THE PRESENTLY PREFERRED EMBODIMENTS

Figure 1:
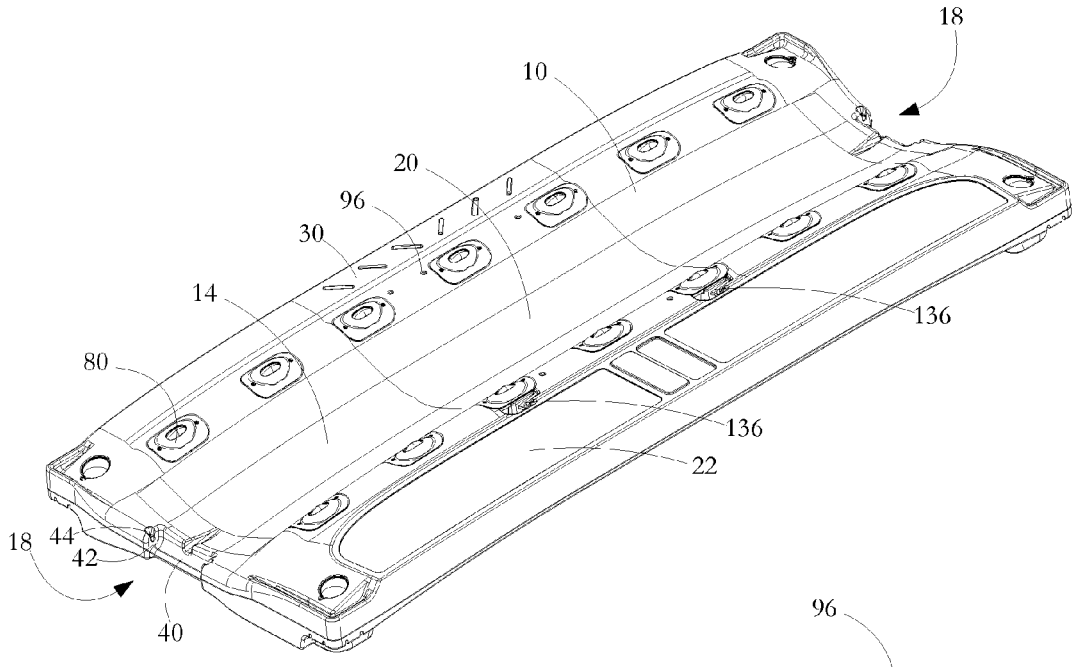
FIG. 1 is an isometric view from above and one end of a PWC drive-on dock platform according to an embodiment of the invention.
Figure 2:
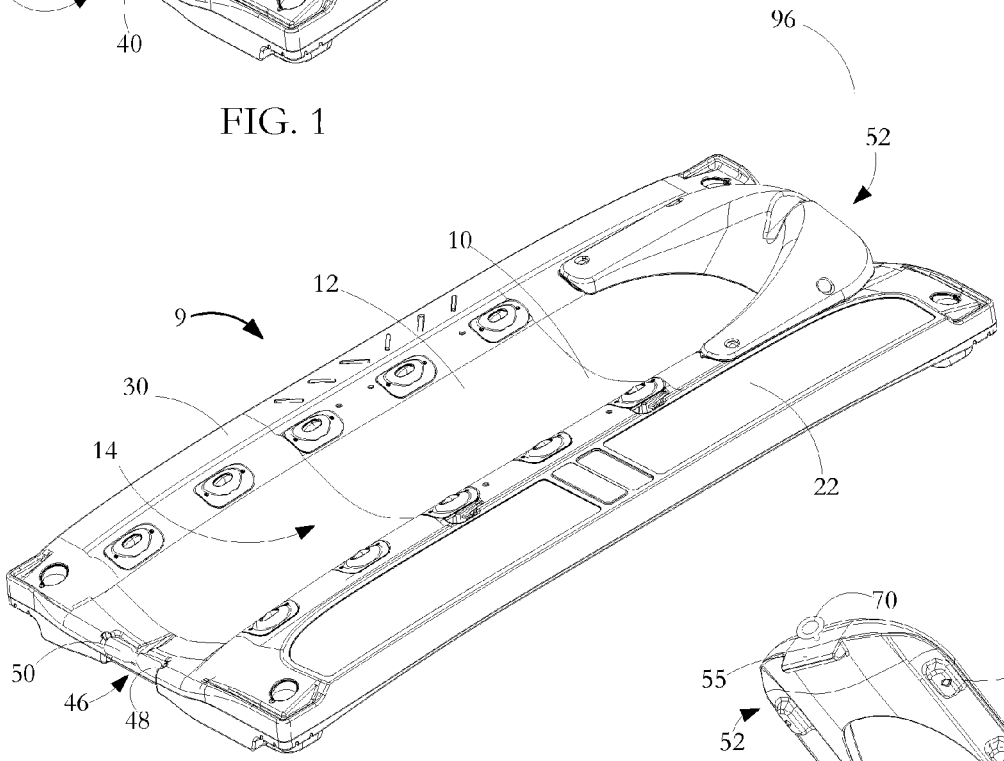
FIG. 2 is an isometric view similar to the view of FIG. 1 but with a bow-stop and a roller unit installed according to an embodiment of the invention.
Figure 3:
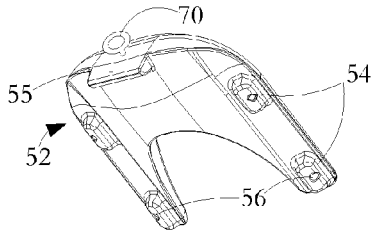
FIG. 3 is an isometric view from below of a bow stop for installation on the platform of FIG. 1 according to an embodiment of the invention.
Figure 4:
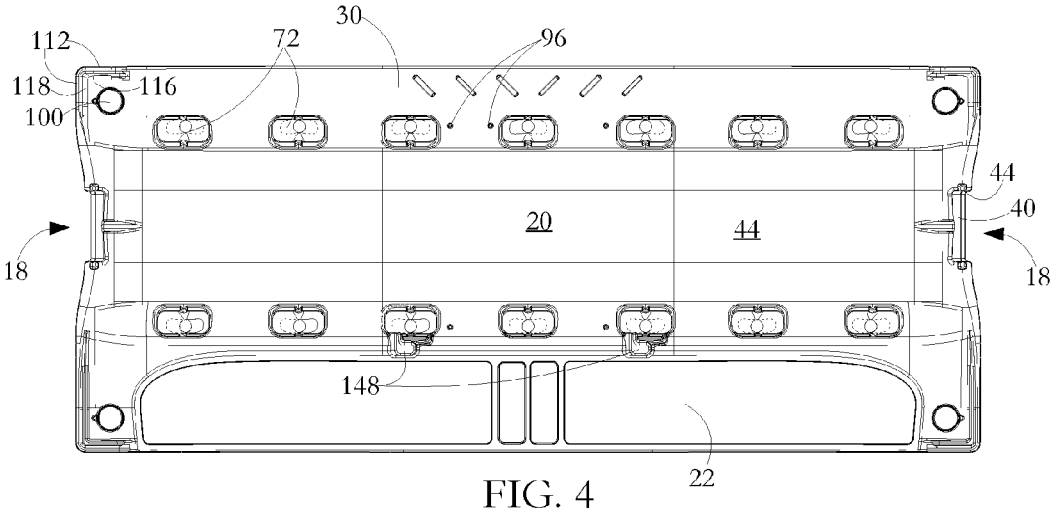
FIG. 4 is a top view of the platform of FIG. 1.
Figure 5:
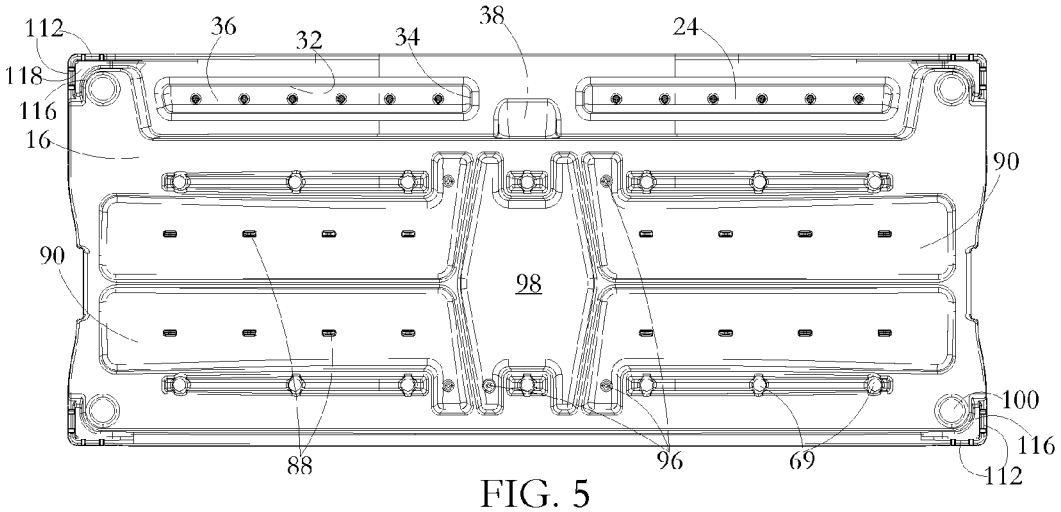
FIG. 5 is a bottom view of the platform of FIG. 1.

Referring in detail to FIGS. 1 to 3, a personal water craft (PWC) drive-on dock 9 has a hollow rotationally molded plastic platform 10 with certain additional parts fitted to the platform. As shown in FIG. 4, the platform has top layer 11 having an upper surface 12 contoured to present an elongate recess 14 extending the length of the platform for receiving the hull of a PWC when the dock is in use and floating. As shown in FIG. 5, the platform has a bottom layer 13 having a lower surface 16 for immersion in water when the dock 10 is floating. The top and bottom layers 11, 13 are highly contoured for style and functional purposes to be described presently and are joined by end and side parts. The recess 14 has PWC access regions 18 at each end, the shape of the platform being such that each access region is generally at the water level when the dock is floating and not bearing weight. This enables a smooth movement of a PWC onto or off the dock when docking or launching. The elongate recess 14 bows upwardly between the access regions and is highest near the center 20 of the dock so that the PWC, when stored, is out of the water.

Figure 6:
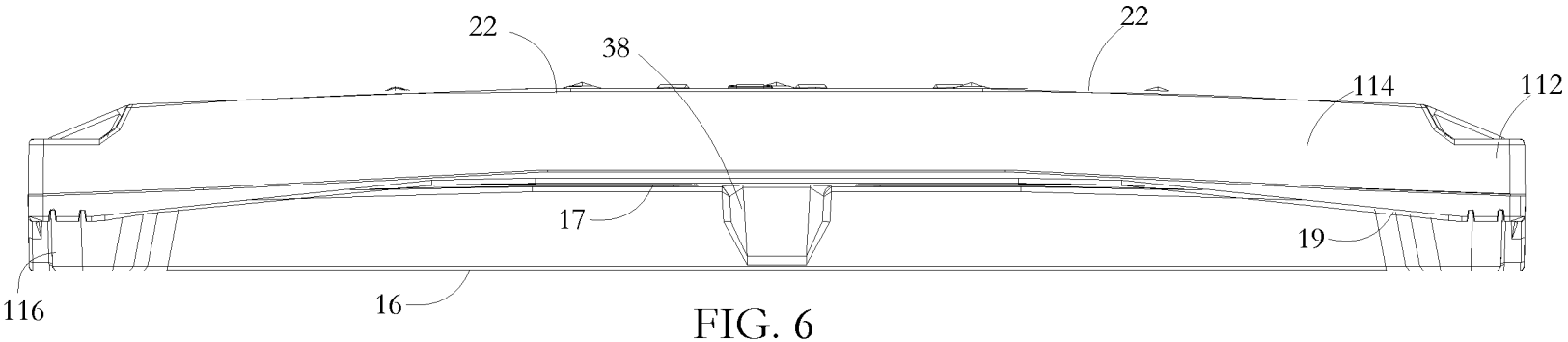
FIG. 6 is a side view of the platform of FIG. 1.
Figure 7:
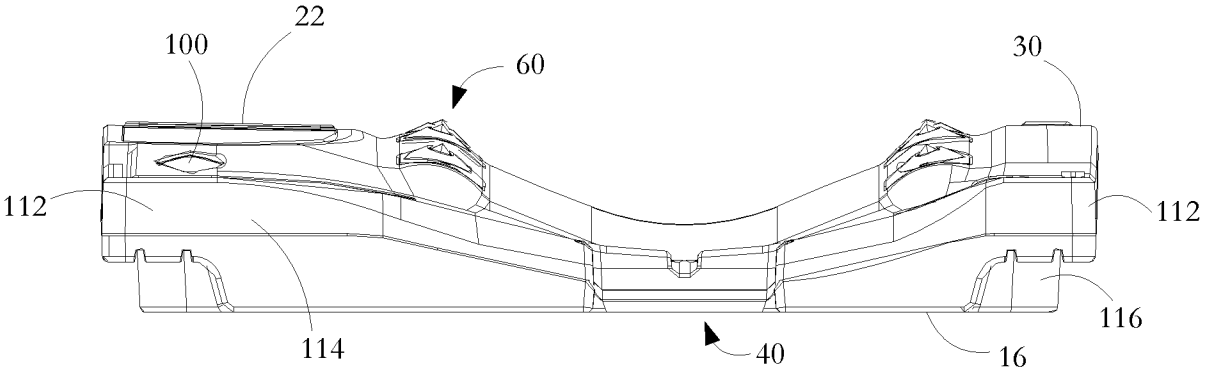
FIG. 7 is an end view of the platform of FIG. 1.

As shown in FIGS. 1 and 2, the elongate recess 14 is asymmetrically located towards one side of the dock platform 10 with the platform having a walkway deck 22 occupying the other side of the platform and extending substantially the length of the platform. The walkway deck 22 provides an operational area for a person to climb onto or off the PWC when it is parked in the recess 14 or to service the PWC such as by cleaning or covering it. The operational area is significantly wider than the thin deck strip 30 located at the other side of the recess 14 as best shown in FIG. 4. In one example, the walkway deck is of the order of 14 inches at its maximum width offering significant ease of boarding. As shown in FIG. 5 and the cutaway view of FIG. 7, the walkway deck section 22 is located over buoyancy chambers 24. The bottom 17 of the walkway deck as shown in FIG. 6 is several inches above the bottom surface 16 of the main part of the dock, the walkway deck bottom surface sloping down towards the ends of the dock 9 so as to provide a bottom mold layer less prone to bending and to provide extra buoyancy at the ends 19 of the dock to counter the effect of a walker moving towards one end or other of the deck 22.

The PWC dock is made by the process of rotational molding in which a heated hollow mold is filled with a charge or shot weight of plastic pellet material. The mold is slowly rotated, typically around mutually perpendicular axes, to cause the softened plastic powder pellets to disperse and stick to the hot interior walls of the mold. To build up an evenly thick layer of plastic, rotation of the mold is maintained in a heated condition and is continued both during the deposition and in subsequent cooling to minimize distortion of the deposited plastic layer. The particular pattern of rotation of the mold is configured to build up more or less material at specific points to avoid areas of weakness or for other reasons. The upper and lower layers 9, 11 of the dock platform 10 have a large area. To avoid undesirable flexure during use, the upper and lower layers are joined or nearly joined by strengthening columns or "kiss-offs" 88 (FIGS. 5A and 8) which are formed during the molding process. A small non water permeable vent is incorporated in the upper layer to ensure that temperature changes do not cause the hollow molding to expand like a balloon to shrink like a raisin to the extent that the outer surface of the mold or the shape of the mold may become permanently distorted.

While the PWC dock molding nominally has a generally flat bottom face 16, this is interrupted at a number of places by open buoyancy chambers and other features. The PWC dock has two forms of buoyancy. Firstly, there is interior buoyancy provided by a sealed chamber or chambers within the molded platform itself. This buoyancy exists regardless of the orientation of the dock. I.e., the dock can be upside down or sideways in the water but, because of the interior buoyancy, it does not sink. Secondly, there is exterior buoyancy provided by chambers that are open at the bottom in the manner of a diving bell. In such chambers, air is initially trapped in the open chamber and is subsequently kept there owing to the chamber orientation and the pressure of the water around and under the dock. Provided that the dock is not re-orientated from a generally level aspect to such an extent that the chamber opening comes out of the water, the trapped air remains in place and continues to provide exterior buoyancy. One feature of the exterior buoyancy is that when the dock is unloaded and level, provided a part of the chamber is above the water level and part is below, the part of the air above the water level will be trapped but not provide buoyancy while the part below is trapped and, because it displaces water, provides buoyancy. However, if the chamber is driven further into the water by the associated part of the dock bearing greater weight and/or changing orientation, there will be an increase in the amount of trapped air below the water level for a particular buoyancy chamber, and therefore an increase in buoyancy provided by that particular chamber.

Figure 8:
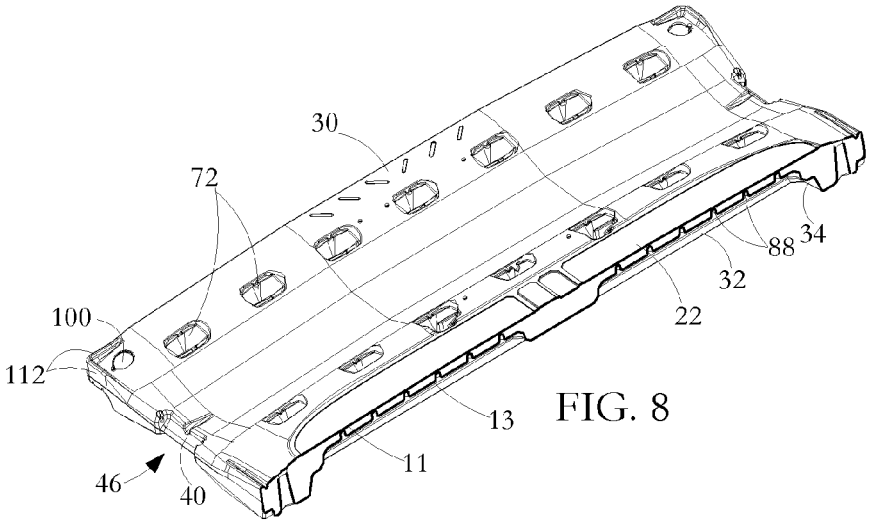
FIG. 8 is an isometric view from above and one side of the platform of FIG. 1 showing a cutaway view of a part of the interior of the platform molding.

As shown in FIG. 5 and the cutaway view of FIG. 8, a pair of open buoyancy chambers 24 is located under the walkway deck 22. The chambers are flanked by side and end walls 32, 34 and by a top wall 36 which has a rib formation to provide strength. A gusset or bridge configuration 38 provides further structural strength. The under-walkway buoyancy could alternatively be configured as several separate open chambers extending substantially the length of the platform or as one or more closed buoyancy chambers.

In the embodiment illustrated, the weight of the dock platform 10 and the interior and exterior buoyancy are configured so that the bottom surface 16 of the floating dock is about 0.75 inches below the water level when the dock is unloaded and about 4 inches below the water level when loaded with a PWC of rated weight. The vertical distance between the water level and the top walls 36 of the buoyancy chambers 24 is also of the order of 4 inches even though water cannot enter the chambers 24 owing to air being trapped in the chambers. When a person steps on to the walkway deck 22, two things may happen. The dock now bears more weight and so tends to settle further into the water. In addition, because the person on the walkway deck 22 is positioned laterally away from the fore-aft centerline of the dock, there may be a tendency for the dock to tip sideways: i.e. for the part of the dock under the person on the walkway deck 22 to settle to a greater depth than other parts of the dock.

However, the center of buoyancy of the dock is not then at the fore-aft centerline but in fact moves to counter the added weight of the person on the walkway deck. The open chambers 24 and the interior of the walkway part of the hollow molded platform comprise a significant percentage of the total buoyancy volume and are situated directly under the walkway deck 22. The chambers also extend of the order of 13 feet from front to back which is the typical length for a single PWC floating dock. In use, the weight of a person stepping onto the walkway deck 22 acts to push the chamber and its trapped air down into the water. This, in turn, is resisted by an upward force corresponding to the volume of water pushed down by trapped air in the open buoyancy chambers and the interior buoyancy of the walkway deck. This substantially balances the weight of the person standing on the walkway so as to keep the dock generally level while presenting a large usable dock area for walking or tending to the PWC, such as covering it, climbing on or off it, etc. Because the PWC dock is asymmetric, walking and other operations in relation to a PWC parked on the dock will normally occur on the walkway deck 22 because it is more comfortable and there is less chance of slipping or falling compared with trying to access the PWC from the other side of the dock where there is essentially no deck at all. However, it may be convenient because of other fixed or floating dock real estate and its deployment to have the PWC positioned in a reverse orientation.

Referring back to FIGS. 1 and 2, the PWC dock platform 10 has a bay 40 at one end which is centrally located at the bottom of the recess 14. There is a counterpart bay 40 at a corresponding location at the other end of the platform. As shown in FIG. 1, the bays 40 are bounded on each side by walls 42 forming part of the main platform molding. Formed in the walls 42 are housings 44 to enable mounting of a centering roller device 46 (FIG. 2). The centering roller device 46 has an axle 48, the ends of which are fixed into opposed housings 44. Mounted on bearings fixed to the axle are truncated conical rollers 50 which are rotatable about the axle 48 when a PWC in contact with and supported by the rollers is moved along the recess 14 onto or off the platform. The roller surfaces are oriented such that a PWC driven or pulled over the rollers 50 tends to migrate towards the center of the recess 14.

Either of the bays 40 can alternatively house a bow stop 52, the bow stop shown separate from the platform in FIG. 3 and installed on the platform in FIG. 2. The bow stop is a hollow molding made in a manner similar to the platform 10 and is generally U-form in shape, having a V-shaped formation 68 to accommodate the bow of a PWC. In use, the PWC is driven or winched up to the bow stop 52 so that the vehicle bow lodges tightly into the V contour. Once it is in place, a cable from the PWC is shackled at an eye 70 attached to the front of the bow stop. Tying the PWC tightly into the V-form cut-out limits the permitted sideways oscillation of the bow of the PWC if the water is choppy or if there is a strong side wind. The bow stop 52 has depending parts 54 that fit into wells 72 formed in the top of the platform 10 to laterally position the bow stop 52 on the platform, and a front depending part that fits into bay 40. The depending parts 54 have apertures 56 allowing the bow stop 52 to be bolted to the platform 10 using bolts that pass from the bottom surface of the platform 10 to the top surface of the bow stop 52. The engagement prevents the bow stop 52 from being dislodged except in the case whether the bow stop 52 is to be deliberately removed.

One instance of deliberate removal is an adjustment to exchange the bow stop 52 at one end of the dock for the centering roller device 46 at the other end. Exchanging the roller and bow stop is done for example when it is desirable to change the orientation of the dock 10 to a position more convenient for driving the PWC onto or off the dock. Such a change may be made necessary because of some required juxtaposition of the PWC dock and a main floating or fixed dock to which the PWC dock is to be attached. Centering roller devices 46 and the bow stop 52 can be mixed and matched. In one example, the bow stop 52 is at one end of the dock and the roller is at the other and, in normal use, the PWC is driven from the other end towards the one end for docking and is backed from the one end to the other end for launching. In another example, the bow stop 52 is at the other end and the roller 46 is at the one end and the PWC is driven from the one end towards the other end for docking and is backed from the other end to the one end for launching. In a further example, no bow stop is used. Instead, there is a centering roller device 46 in each bay 40 and the PWC is driven forwardly onto the dock from one end for docking and then driven forwardly off the other end for launching. The selection and positioning of the centering roller device(s) 46 and bow stop 52 is made with a view to most conveniently positioning the walkway deck 22 in relation to other units of the docking system to which the PWC dock is to be attached.

Referring back to FIGS. 1 and 2, the molded dock 10 has a number of the wells 72 formed in its upper surface 12. Those of the wells not used to locate the bow stop 52 each accommodates a roller 74 which is mounted to rotate about an axis generally orthogonal to the fore aft line of the dock 9. The wells 72 are distributed along the length of the dock and are located at positions at each side of the recess 14 where the recess 14 transitions to the decks 22 and 30. The array of wells 72 is generally symmetrically disposed about the centre line of the recess 14. In use, the rollers 74 support a PWC when it is at rest and when the PWC is moved along the dock for docking or launching, the rollers 74 upon rotation thereof facilitating fore-aft movement of the PWC.

Figure 9:
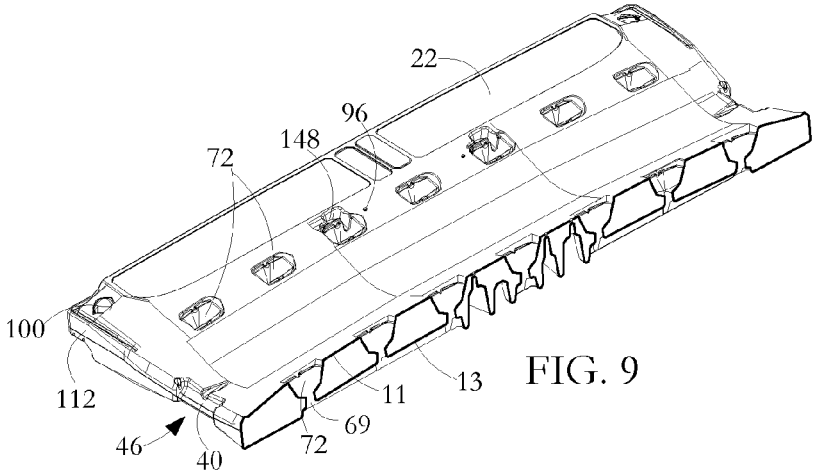
FIG. 9 is an isometric view from above and the other side of the platform of FIG. 1 showing a cutaway view of another part of the interior of the platform molding.
Figure 10:
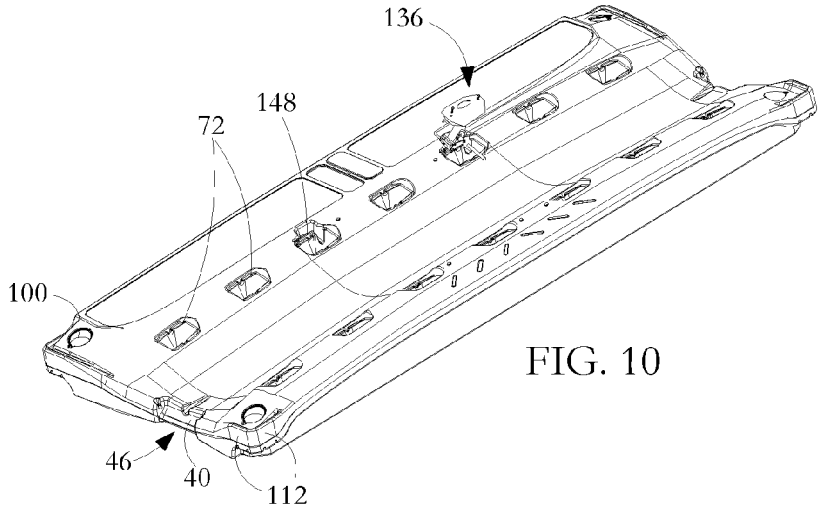
FIG. 10 is an isometric view from above and the other side of the platform of FIG. 1 showing a brake and roller assembly for installation in the platform.
Figure 11:
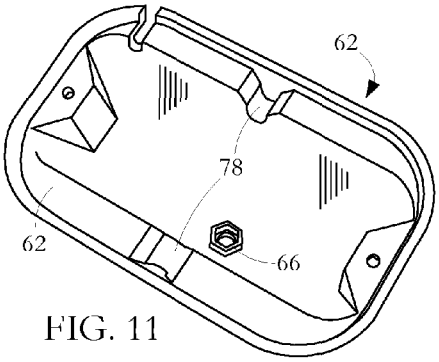
FIG. 11 is an isometric view of a part of a housing for installation in the platform and for housing a roller assembly according to an embodiment of the invention.
Figure 12:
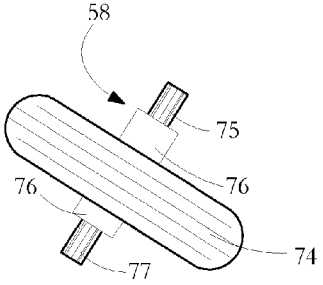
FIG. 12 is an isometric view of roller assembly for installation in the housing of FIG. 10.

Each roller 74 is rotatable on an axle 58, the roller assemblies being mounted in respective housings 60 (FIG. 10) which as shown in FIGS. 11 and 12 each comprises a cap part 80 and a cup part 62 which are bolted together at respective flange regions 64. Each of the housings 60 has a bolt hole 66 for alignment with a corresponding bore 69 through the platform 10 from the associated well 72 (FIG. 9) to enable the housing 60 to be bolted in place. As shown in FIG. 5, reinforcing bars (not shown) extending along recesses 73 in the bottom layer of the platform mold have bolt holes which align with the bores 69 and 66 for receiving bolts used to secure the cup part 62 of housing 60 to the platform 10. The roller axles 58 are dimensioned to snap fit within housings 78 molded into the walls of the wells as shown in FIGS. 11 and 12. Each roller assembly has spacers 76 dimensioned so that an axle part 75 at one side of the roller projecting further from the roller than the axle part 77 at the other side of the roller. This allows the roller axle 58 to be removed from its housings 78, reversed, and repositioned in the housings without removing the cup art 62. Consequently, depending on the orientation of the axle parts 75, 77, rollers 74 of a laterally juxtaposed pair are either relatively widely spaced or relatively narrowly spaced so as to accommodate PWCs of different width or hull shape. Each cap 80 has an upper contour shaped generally to match the level and curvature of the part of the platform upper surface 12 surrounding the cap. The cap has a slot 82 to accommodate a top part of the associated roller 74, the slot 82 being offset from the cap center to accommodate roller reversal. For a roller reversal, the cap part 80 is similarly reversed. As shown in FIGS. 11 and 12, each roller 74 projects about 1 inch above the surface of the cap 80. The roller has a diameter of the order of 5 inches which means that, in a fore-aft direction, the angle between the face of a cap 80 and the circumference of its associated roller 74 is no more than a few degrees. The low angle is of advantage for moving a PWC in the fore-aft direction, especially if the PWC hull bottom is formed with ridges or similar cross formations which might otherwise make it difficult for the PWC to ride up onto and over a conventional roller. A common characteristic of modern PWCs is that they have bottom ridges with the ridge wall facing away from the forward direction of travel of the PWC. This presents a problem for PWCs that are being launched backwards since the ridges may engage with the surfaces of rollers of small radius of curvature and prevent further movement absent the application of appreciable extra force.

Figure 13:
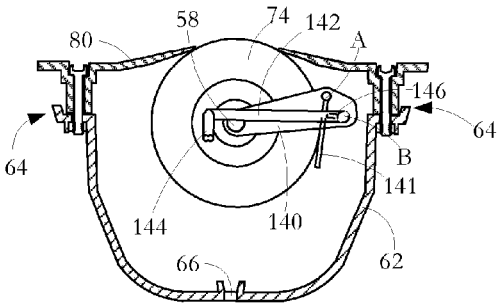
FIG. 13 is a side sectional view of the housing of FIG. 11, the housing accommodating a roller/brake assembly according to an embodiment of the invention, the roller/brake assembly in brake applied condition.
Figure 14:
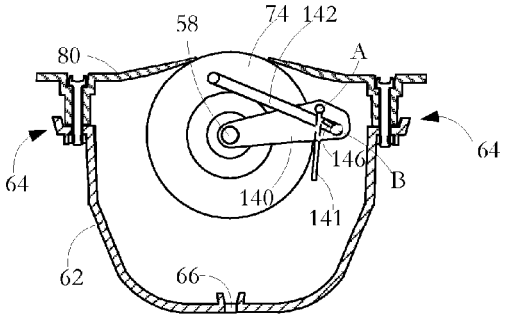
FIG. 14 is a side sectional view similar to FIG. 13 showing the roller/brake assembly in brake released condition.
Figure 15:
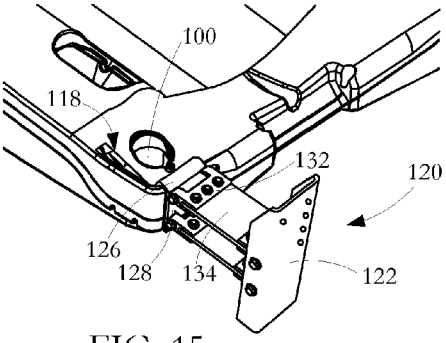
FIG. 15 is an isometric view from above and one side of one corner of drive-on dock platform according to an embodiment of the invention, the platform shown with a hinge attachment.

When a PWC is driven or pulled up onto a dock port of the sort described, it is desirable for the craft to remain in place when unattended. Because the PWC does not have an internal brake mechanism such as generally exists in a road vehicle, a braking mechanism is installed on the dock port. In the dock of the present invention, a PWC can be driven onto the dock platform from either direction depending on where the bow stop is anchored. It is desirable therefore to have a brake mechanism which can be deployed to prevent the PWC from accidentally moving in either direction. The majority of the rollers 74 function as idler rollers but the arrangement includes two brake roller assemblies 136 as shown more clearly in FIGS. 12 and 13. The brake elements include a yoke form bracket having a pair of flanges 140 located on opposite sides of the associated roller 74. The bracket is mounted for angular movement about the roller axis 58. A brake arm 141 which is freely rotatable about axis A, extends between the flanges 140. A crank 142 having a handle 144 has a bridging section extending between the flanges 140 to permit rotary motion about axis B, the bridging section having an integral bias piece 146. In use, the handle 144 is moved to turn the crank 142 between the positions shown in FIGS. 13 and 14 to apply and release the brake. To apply the brake, the handle 144 is moved anti-clockwise to the position shown in FIG. 13 at which the brake arm 141 is pressed against the yieldable roller 74. The handle 144 in this position is prevented from rotating further in an anticlockwise direction by engagement of a part of the handle with a detent 148 (FIG. 4) formed in the platform 10. The handle 144 is prevented from accidental clockwise release by the spring engagement of the compressed roller 74 against the brake arm 141 which is pressed against the roller by the end of the bias piece 146. To release the brake, as shown in FIG. 14, the handle 144 is pulled upwardly to turn the crank 142 clockwise about axis B. This moves the bias piece 146 out of engagement with the brake arm 141 so that the brake arm is no longer biased against the roller 74. Both brake assemblies 136 are configured to permit setting of the brake to inhibit movement of the PWC in either direction along the dock. The brake is released by a user inserting fingers under the crank handle 144 at a detent 148, the wells 60 for the braked rollers being of slightly different form from the wells 60 for the idler rollers so as to accommodate the detent 148. While a dual braking mechanism enables separate brake operations between unbraked and braked "left"/braked "right" positions, other brake configurations can be adopted. For example, a single brake arrangement might have two brake detent positions, respectively brake left and brake right, with an intermediate unbraked position.

Figure 5A:
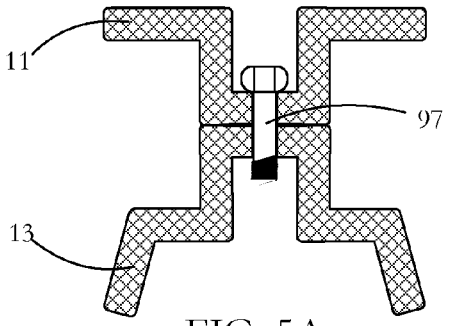
FIG. 5A is a sectional view of a vent and plug used for buoyancy adjustment in a dock according to an embodiment of the invention.

Referring back to FIG. 5, the dock platform has four open buoyancy chambers 90 symmetrically located about a central open buoyancy chamber 98. Above the chambers 90, 98 when the dock is in its floating orientation, vent passages 96 extend through respective columns forming parts of the platform molding, the columns bridging the top and bottom layers of the hollow platform molding. As shown in FIG. 5A, screw plugs 97 received in each of the passages 96 can be unscrewed to permit air to be vented from the underlying open chamber 90, 98 for dock set-up but are kept screwed tight during normal use to prevent venting. Each of the four open buoyancy chambers 90 is generally L-shaped with a small chamber section 92 underlying a respective vent passage 96 and a larger section 94 extending along the dock 10 so as to embrace a volume of trapped air. If the plugs 97 are unscrewed, trapped air in the buoyancy chamber 90, 98 escapes as water is allowed to enter the chamber from below and displace the escaping air. The effect of air replacement by water in any of the buoyancy chambers 90, 98 is to reduce the buoyancy contribution from that particular chamber. The buoyancy chambers can be selectively emptied or partially emptied of air to effect levelling of the dock 10 and to accommodate the expected weight and expected weight distribution on the dock. For example, if weight position during use tends to concentrate at the back of the dock, air is vented from one or both of the two front chambers. Similarly, if weight position during use tends to concentrate at the front of the dock, plugs are unscrewed to vent air from one or both of the two back chambers for leveling purposes. If weight position during use tends to cause the dock to list towards port, air is vented from one of both of the chambers positioned on the starboard side. Similarly, if weight position during use tends to cause the dock to list towards starboard, the screw plugs are unscrewed to vent air from one of both of the chambers positioned on the port side. In one example, the maximum volume of air that can be trapped in each of the chambers 90 is of the order of 1.5 cubic feet which equates to 100 lbs of buoyancy, while the central chamber, when filled with air, represents about 70 lbs of buoyancy. Vent passages 96 are sealed from the interior of the main mold to prevent ingress of water from the chambers into the hollow mold interior. To restore full buoyancy at any time in any of the open chambers 90, 98 that has been filled with water, the relevant plug is screwed home to prevent air flow along the passage 97. The dock 10 is then tipped over to expose the bottom of the open chamber to the air. Finally, the dock 10 is returned to an untipped position with a new volume of air trapped in the buoyancy chamber. The leveling functionality is of value if the PWC dock may support both large PWCs, which may be more than 1000 pounds in weight, as well as recently introduced shorter lightweights which are sufficiently small that they may be parked at one or other end of the dock and so tend to alter the fore-aft aspect of the dock. Typically, set up with the various open buoyancy chambers to achieve ideal buoyancy and orientation is set as an initial event with selective venting being done to accord with the weight and size of the PWC and the weight and size of its operator(s). Obviously, adjustment can be made later for convenience and in response to weight and size changes. As shown in FIG. 5, near kiss-offs are positioned at strategic locations to provide the platform mold with structural strength by preventing the top layer of the mold from flexing downwardly more than is desirable when weight is applied. The near kiss-offs are vertically aligned, thickened mold regions that extend upwardly from the bottom mold layer and optionally downwardly from the top mold layer so that in a rest state, the two parts at each location are separated by about one quarter of an inch. In this way, when someone steps onto the walkway deck or when the PWC rests in the recess tending to cause downward movement of the platform top layer, this is resisted by the structural integrity of the bottom layer and the underlying water pushing the bottom layer up against the top layer at the near kiss-offs.

The PWC dock 9 is a floating structure. In use, it needs to be anchored to a stable structure such as a fixed or floating dock or other permanent or semi-permanent fixture. One way of anchoring the dock 9 is by means of one or more pipes or cylindrical piles driven into the lake or sea bed. Referring to FIGS. 1 and 2, inboard of each corner of the platform 10 is a vertical cylindrical passage 100 which extends right through the molded dock, each passage 100 being bounded by a cylindrical wall forming part of the rotational molding. In use, the dock 9 is floated into position and a pipe or cylindrical pile having an outer diameter allowing it to be loosely received in the cylindrical passage 100 is driven vertically down through the passage at a desired position and hammered into the lake or sea bed. In use, the dock 10 can then float up and down the anchored pipe but cannot float laterally away from it. A pipe anchor can be driven down at any of the passages 100 and the dock can have more or less than the four passages illustrated. The post mount is particularly valuable for attaching the PWC port to a fixed dock where the water is subject to tidal or other level changes. If none or not all of the passages are used when anchoring the dock, then for aesthetic and safety reasons the passages 100 can be plugged by a plug having a top cap shaped to match the contour of the dock upper surface around the entrance of the passage 100. To install a suitable plug, it is rotated to a position where the surface contours will match and then pressed down into position. A bottom section is made slightly tapered and formed with a locating ridge. As the plug is pressed downwardly, it is compressed inwardly with the passage wall. At a certain point, the ridge comes level with a corresponding projection in the passage wall and, on further insertion, snap locates allowing the compressed plug to expand radially and fill the open void at the widened area of the ridge.

Figure 16:
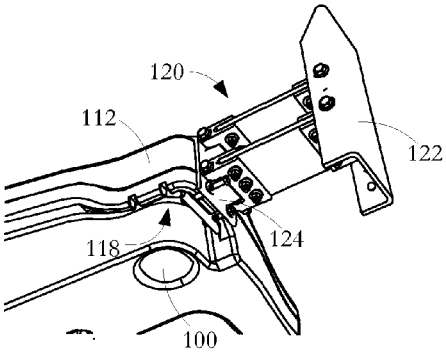
FIG. 16 is an isometric view from below showing the corner and hinge attachment of FIG. 15.

As well as the post or pipe mounts, the PWC dock also has plate formations molded at its corners adapted for cooperation with a hinge arrangement to fix the port to a jetty or fixed or floating main dock. As shown in the detail views of FIGS. 6 and 7, at each corner of the dock, flat sections 112 integral with the platform molding are orthogonally disposed relative to one another and are spaced from the corner 116 of the molding. The flat sections 112 are integral with adjacent side and end portions 114 of the platform and, as shown in FIGS. 16 and 17, provide an access space 118 at the corner enabling attachment of one end of a corresponding hinge mechanism for joining the dock 9 to a fixed dock. An exemplary hinge mechanism 120 has a vertical section 122 adapted to be fixed in a vertical orientation to a main dock wall to which the PWC port is to be hingedly attached. Parallel to that, the hinge mechanism has a section 124 adapted to be fixed in a vertical orientation to one or other of the flat sections 112, being either a side wall or an end wall depending on the desired port configuration when mounted to the dock wall. The section 124 has respective hook portions 126 to embrace the top and bottom of the adjacent flat section 112. The hook portions 126 are separable from each other and from an attachment plate 128 to permit the hook portions 126 to be positioned around the top and bottom of the flat section 112 as part of the hinge mounting procedure. Once in place, the hook portions 126 and plate 128 are fixed together to make an integral structure. Hingedly mounted to the top and bottom hook portions are U-form retainers 132 with a layer of flexible belting 134 fixed within each retainer 132. Remote ends of the flexible belting are fixed in a similar fashion to the vertical section 122. Cross-link pieces 130 are hingedly mounted to the vertical section 122. The vertical section 122 can be a single plate or can be similar to the section 124 in having separable top and bottom pieces with a plate fixed between, the arrangement to allow the vertical height of the section 122 to be adjusted. However, the vertical section 122 does not have hook portions such as portions 126 because, in use, it is easier simply fix the plate or plates 122 against an adjacent dock wall or similar fixture. In use, the double hinge mechanism 120 allows the PWC dock to move up and down in response to changes of level of the water. The nature of the parallelogram structure of the hinge mechanism tends to limit twisting resulting in the application of leveling forces as the dock moves up and down.

What is claimed is:

1. A personal water craft (PWC) dock comprising a molded platform, the platform having a main section having an upper surface contoured to present an elongate recess extending the length of the platform for receiving and supporting a hull of a personal water craft and a lower surface, at least some of the lower surface for engaging water when the dock is floating, the elongate recess asymmetrically located towards one side of the platform, the platform having a walkway deck section extending substantially the length of the platform and located towards the other side of the platform, the walkway deck section located over a buoyancy chamber, the elongate recess having access regions at each end thereof, the access regions generally laterally central of the elongate recess and generally at the water level when the dock is floating and not bearing weight, the elongate recess bowing upwardly between the access regions, the main platform section having first and second bay arrangements at respective access regions, the first bay arrangement configured to receive in locking engagement a detachable centering roller in a first dock configuration, the second bay arrangement configured to receive in locking engagement a detachable bow stop in said first dock configuration, the first bay arrangement configured to receive in locking engagement a detachable bow stop in a second dock configuration, the second bay arrangement configured to receive in locking engagement a detachable centering roller in the second dock configuration.

2. A personal water craft (PWC) dock comprising a molded platform, the platform having a main section having an upper surface contoured to present an elongate recess extending the length of the platform for receiving and supporting a hull of a personal water craft and a lower surface, at least some of the lower surface for engaging water when the dock is floating, the elongate recess asymmetrically located towards one side of the platform, the platform having a walkway deck section extending substantially the length of the platform and located towards the other side of the platform, the walkway deck section located over a buoyancy chamber, the dock when floating and bearing a PWC of rated weight in the recess and no human weight on the walkway deck section having the walkway deck section at a first height and substantially level, the dock when floating and bearing a PWC of rated weight in the recess and a human weight on the walkway deck section having the walkway deck section at a second height and substantially level, the lowering of the height from the first height to the second height causing said buoyancy chamber to displace a volume of water substantially equal to the human weight, the buoyancy chamber being downwardly open whereby, in use, the buoyancy is trapped air interfacing with water on which the dock floats.

3. A dock as claimed in claim 1, the part of the platform other than the walkway deck section being generally symmetrical about a fore-aft axis centered on the elongate recess.

4. A dock as claimed in claim 1, further comprising a well in the platform upper surface and a roller mounted in the well for supporting a PWC, the roller upon rotation thereof permitting fore-aft movement of the PWC.

5. A personal water craft (PWC) dock comprising a molded platform, the platform having a main section having an upper surface contoured to present an elongate recess extending the length of the platform for receiving and supporting a hull of a personal water craft and a lower surface, at least some of the lower surface for engaging water when the dock is floating, the elongate recess asymmetrically located towards one side of the platform, the platform having a walkway deck section extending substantially the length of the platform and located towards the other side of the platform, the walkway deck section located over a buoyancy chamber, further comprising a well in the platform upper surface and a roller mounted in the well for supporting a PWC, the roller upon rotation thereof permitting fore-aft movement of the PWC, the roller having a diameter in the range 4 to 6 inches, the well substantially closed by a cap having an aperture therein with a top part of the roller projecting through the aperture.

6. A personal water craft (PWC) dock comprising a molded platform, the platform having a main section having an upper surface contoured to present an elongate recess extending the length of the platform for receiving and supporting a hull of a personal water craft and a lower surface, at least some of the lower surface for engaging water when the dock is floating, the elongate recess asymmetrically located towards one side of the platform, the platform having a walkway deck section extending substantially the length of the platform and located towards the other side of the platform, the walkway deck section located over a buoyancy chamber, further comprising a well in the platform upper surface and a roller mounted in the well for supporting a PWC, the roller upon rotation thereof permitting fore-aft movement of the PWC, the roller having an associated braking mechanism settable for braking the roller against rotation in a first longitudinal direction.

7. A personal water craft (PWC) dock comprising a molded platform, the platform having a main section having an upper surface contoured to present an elongate recess extending the length of the platform for receiving and supporting a hull of a personal water craft and a lower surface, at least some of the lower surface for engaging water when the dock is floating, the elongate recess asymmetrically located towards one side of the platform, the platform having a walkway deck section extending substantially the length of the platform and located towards the other side of the platform, the walkway deck section located over a buoyancy chamber, further comprising a well in the platform upper surface and a roller mounted in the well for supporting a PWC, the roller upon rotation thereof permitting fore-aft movement of the PWC, the roller forming part of a roller arrangement demountably mounted in a mounting arrangement in either of a first and a second positions, the roller located further outboard in the second position than in the first position, the roller arrangement being demountable from the mounting arrangement and reversible as between the first and second mounting positions to change the inboard/outboard position of the roller.

8. A dock as claimed in claim 6, the roller and the braking mechanism forming part of an integrated assembly fixed into the well.

9. A personal water craft (PWC) dock comprising a molded platform, the platform having a main section having an upper surface contoured to present an elongate recess extending the length of the platform for receiving and supporting a hull of a personal water craft and a lower surface, at least some of the lower surface for engaging water when the dock is floating, the elongate recess asymmetrically located towards one side of the platform, the platform having a walkway deck section extending substantially the length of the platform and located towards the other side of the platform, the walkway deck section located over a buoyancy chamber, further comprising a well in the platform upper surface and a roller mounted in the well for supporting a PWC, the roller upon rotation thereof permitting fore-aft movement of the PWC, there being a plurality of such wells and associated rollers, the rollers including at least one pair thereof symmetrically disposed about the centre line of the recess, at least some rollers located towards one end of the dock and at least some rollers located towards the other end of the dock.

10. A dock as claimed in claim 6, further comprising a second roller having a second associated braking mechanism, the second braking mechanism settable for braking the second roller against rotation in a second direction opposite to the first direction.

11. A personal water craft (PWC) dock comprising a molded platform, the platform having a main section having an upper surface contoured to present an elongate recess extending the length of the platform for receiving and supporting a hull of a personal water craft and a lower surface, at least some of the lower surface for engaging water when the dock is floating, the elongate recess asymmetrically located towards one side of the platform, the platform having a walkway deck section extending substantially the length of the platform and located towards the other side of the platform, the walkway deck section located over a downwardly open buoyancy chamber, a passage through the hull above the buoyancy chamber and communicating with the chamber, and a closure device demountably mounted in the passage and operable to close or open the passage to vent trapped air from the buoyancy chamber.

12. A dock as claimed in claim 11, there being a plurality of such downwardly open buoyancy chambers and a respective plurality of passages and demountable closure devices, the closure devices independently operable to vent volumes of trapped air from at least some of the open buoyancy chambers, whereby to adjust the orientation of the dock when floating.

13. A dock as claimed in claim 12, the plurality of downwardly open buoyancy chambers including relatively fore and aft downwardly open buoyancy chambers for adjusting static pitch of the dock and including relatively port and starboard downwardly open buoyancy chambers for adjusting static roll of the dock.

14. A dock as claimed in claim 1, the molded platform being rotationally molded.

* * * * *